US008585234B2

(12) United States Patent
Ding

(10) Patent No.: US 8,585,234 B2
(45) Date of Patent: Nov. 19, 2013

(54) SWINGABLE ELECTRONIC CANDLE

(75) Inventor: Yingqi Ding, Nantong (CN)

(73) Assignees: Shanghai Q Mall & Co. Ltd., Shanghai (CN); Nantong Ya Tai Candle Arts & Crafts Co., Ltd., Nantong (CN)

( * ) Notice: Subject to any disclaimer, the term of this patent is extended or adjusted under 35 U.S.C. 154(b) by 0 days.

(21) Appl. No.: 13/586,160

(22) Filed: Aug. 15, 2012

(65) Prior Publication Data

US 2013/0258648 A1 Oct. 3, 2013

(30) Foreign Application Priority Data

Mar. 30, 2012 (CN) ..... 2012 1 0088362

(51) Int. Cl.
*F21L 4/00* (2006.01)

(52) U.S. Cl.
USPC ..... 362/190; 362/157; 362/191

(58) Field of Classification Search
None
See application file for complete search history.

(56) References Cited

U.S. PATENT DOCUMENTS

| | | | | |
|---|---|---|---|---|
| 7,121,686 | B1 * | 10/2006 | Chu | 362/234 |
| 7,360,935 | B2 * | 4/2008 | Jensen et al. | 362/555 |
| 8,132,936 | B2 * | 3/2012 | Patton et al. | 362/249.02 |
| 2007/0223217 | A1 * | 9/2007 | Hsu | 362/183 |
| 2008/0094825 | A1 * | 4/2008 | Silver | 362/161 |
| 2012/0307516 | A1 * | 12/2012 | Ding | 362/569 |
| 2012/0307517 | A1 * | 12/2012 | Ding | 362/569 |

* cited by examiner

*Primary Examiner* — Natalie Walford
(74) *Attorney, Agent, or Firm* — Rankin, Hill & Clark LLP

(57) ABSTRACT

A swingable electronic candle includes a candle body having a cavity inside which is disposed a candlewick that includes a candle end and an electromagnetic coil underneath the candle end. The electromagnetic coil is driven by a drive circuit connected with a power supply. The candle end includes a support, a support frame and the candlewick. The support frame includes a large support axis and a small support axis that cross. The large support axis is disposed with a hollow frame to support the small support axis. Ends of the small support axis are movably supported in the hollow frame. Ends of the large support axis are movably hung to the support. The top of the candlewick is disposed with a flame head that is above the small support axis and the bottom of the candlewick is disposed with a magnet that is under the small support axis.

9 Claims, 3 Drawing Sheets

SWINGABLE ELECTRONIC CANDLE

FIELD OF THE INVENTION

The present invention relates to an electronic candle, more particularly to a swingable electronic candle.

BACKGROUND OF THE INVENTION

Since electronic candles come into being, they become increasingly popular because they are safe, convenient, energy-saving and environmental friendly. Especially in European countries and American, they have the tendency to replace traditional candles.

However, most of the existing electronic candles only have a light-emitting body. They are less dynamic and have low degree of simulation. Some swingable electronic candles are roughly made and the swingable heads are not flexible and likely to be clamped.

SUMMARY OF THE INVENTION

The objective of the present invention is to overcome the disadvantages of the prior art by providing a swingable electronic candle, which can swing freely and whose end can swing with 360°. The candle end is highly flexible and will not be clamped.

The objective of the invention is achieved by the following technical solution: a swingable electronic candle comprises a candle body, whose inside is a cavity. Inside said cavity is disposed with a candlewick. Said candlewick includes a candle end and an electromagnetic coil underneath said candle end. The electromagnetic coil is driven by a drive circuit and said drive circuit is connected with a power supply. Said candle end includes a support, a support frame movably hung to the support and a candlewick supported by said support frame. Said support frame includes a large support axis and a small support axis that cross with each other. Said large support axis is disposed with a hollow frame in the middle to support said small support axis. The two ends of said small support axis are movably supported in said hollow frame. The two ends of said large support axis are movably hung to the support. Said candlewick and said small support axis are cross-connected with each other. The top of said candlewick is disposed with a flame head that is above said small support axis and the bottom of said candlewick is disposed with a magnet that is under said small support axis.

As an improvement, said large support axis and said small support axis cross each other with an angle of 90°.

As an improvement, said hollow frame is an annular frame.

As an improvement, said support is a hollow cylinder and the upper edge of said hollow cylinder is disposed with a gap to support said large support axis.

As an improvement, said candle end is disposed with a cover with a through hole to cover said hollow cylinder, and said flame head passes through the through hole of said cover to form a flame surrounding the candlewick.

As an improvement, said cover with through hole is disposed with an aperture used to mount a light-emitting body, and said aperture is near the root of said flame head.

As an improvement, said support is disposed with a small hole used for a wire to connect said light-emitting body with the power supply. Any size of battery can be used as the power supply.

As an improvement, the sidewall of said hollow frame is disposed with two corresponding openings, and two ends of said small support axis are movably supported in the openings.

As an improvement, the bottom edge of said cover with though hole is disposed with two raised clamps and said clamps match with the gap of t said hollow cylinder. Said cover with through hole can either serve as a whole or be formed by said hollow cylinder clamped by two vertical and separated half-cover bottoms. The clamp can fasten the large support axis that is hanging at the gap of the upper edge of the hollow cylinder so as not to fall over or be raised up.

The candle body of the swingable electronic candle provided by the invention can be made of wax or plastics. It can also be a glass container or a transparent container filled with wax or a light-emitting body shaped like a candle. The light-emitting body is the candlewick of the swingable electronic candle provided by the invention.

Advantages of the invention are summarized below: the electronic candle provided by the invention is fully dynamic and has high degree of simulation. The candle end is flexible and swingable freely with 360° and it will not be clamped. It is very beautiful when the light-emitting body near the root of the flame head flashes with the swingable flame head in the background.

DETAILED DESCRIPTION OF THE EMBODIMENTS

Figure 1:
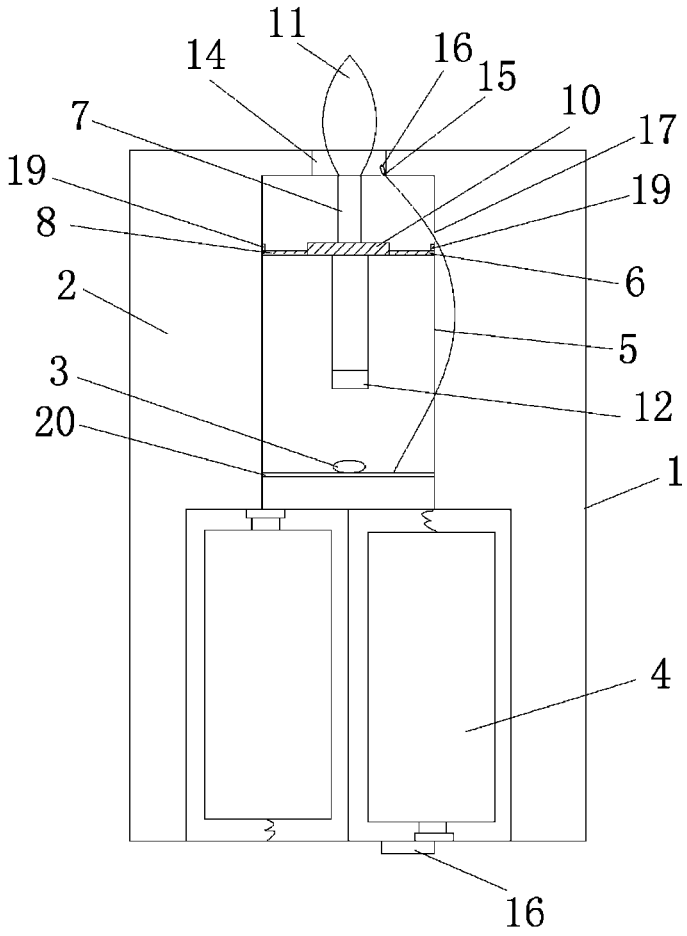
FIG. 1 is a structural representation of the invention.
Figure 2:
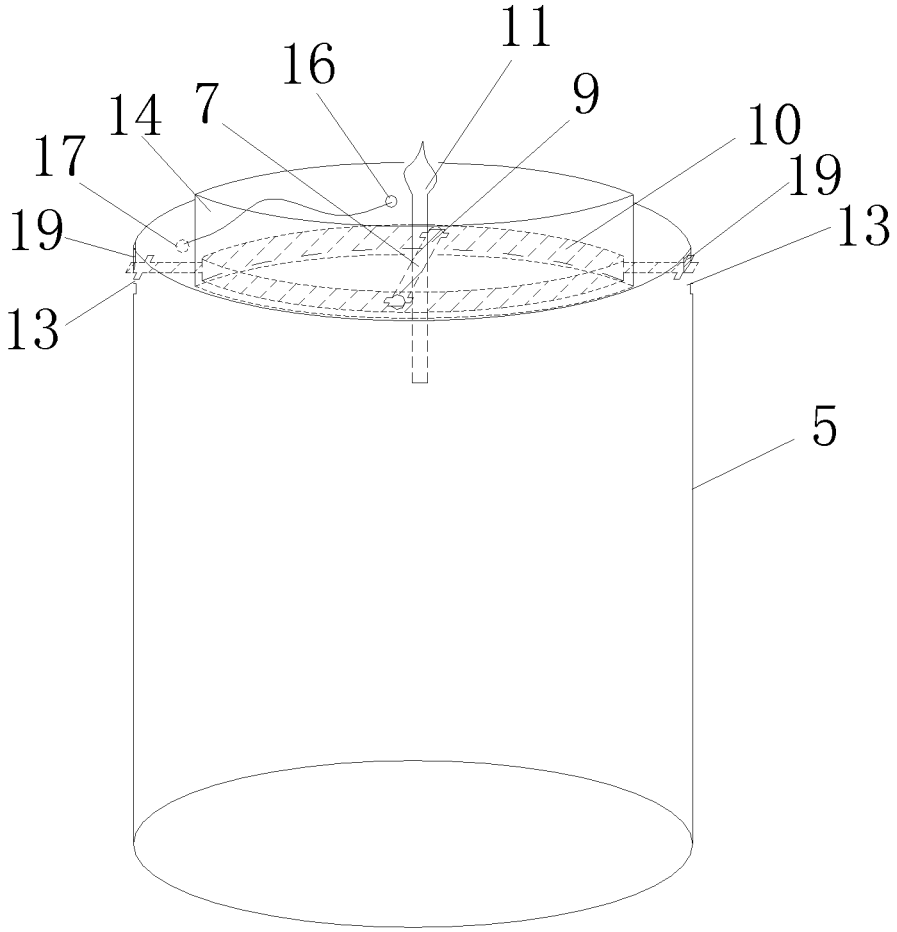
FIG. 2 is a structural representation of a candle end of the invention.
Figure 3:
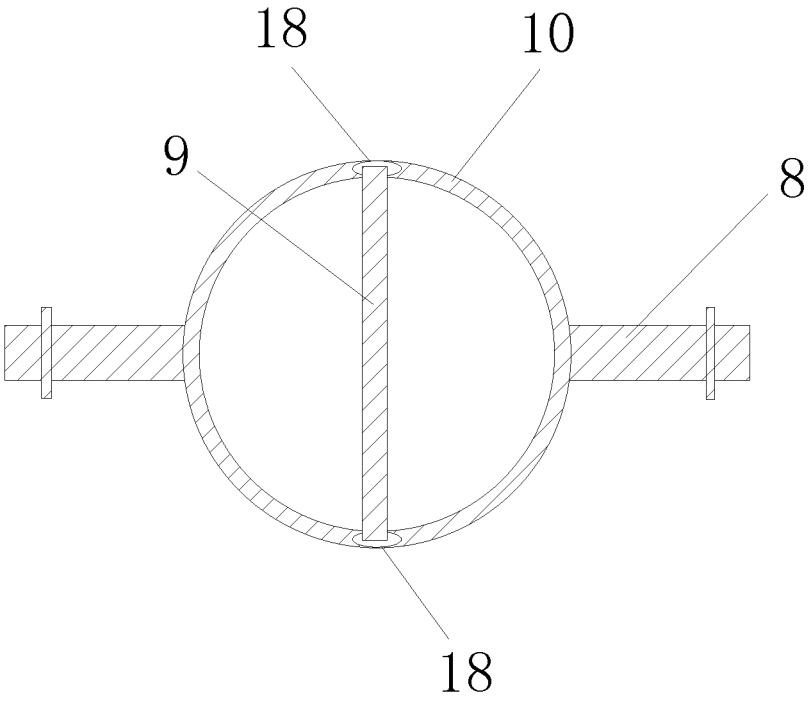
FIG. 3 is a top view of a support frame of the candle end.
Figure 4:
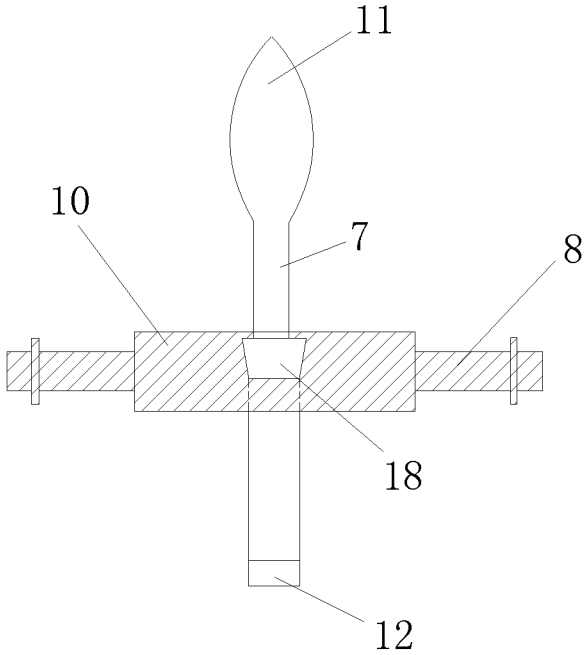
FIG. 4 is a front view of the support frame with a candlewick.

As shown in FIGS. 1, 2, 3 and 4, a swingable electronic candle comprises a candle body 1, whose inside is a cavity 2. Inside the cavity 2 is disposed with a candlewick. The candlewick includes a candle end and an electromagnetic coil 3 underneath the candle end. The electromagnetic coil 3 is mounted on a chip 20 and the chip 20 is connected with a drive circuit.

The electromagnetic coil 3 is driven by the drive circuit, which is connected with a power supply 4. The candle end includes a support 5 made of a hollow cylinder, a support frame 6 movably hung to the support 5 and a candlewick 7 supported by the support frame 6. The upper end of the hollow cylinder is disposed with a gap 13 to support a large support axis 8. The support frame 6 includes the large support axis 8 and a small support axis 9 that cross with each other with an angle of 90°. The large support axis 8 is disposed with a hollow frame 10 in the middle to support the small support axis 9. The sidewall of the annual hollow frame 10 is disposed with two corresponding openings 18. The two ends of the small support axis 9 are movably supported in the openings 18. The two ends of the large support axis 8 is movably hung to the support 5. The candlewick 7 and the small support axis 9 are cross-connected with each other. The top of the candlewick 7 is disposed with a flame head 11 that is above the small support axis 9 and the bottom of the candlewick 7 is disposed with a magnet 12 that is under the small support axis 9. The candle end is disposed with a cover 14 with a through hole to cover the hollow cylinder. The flame head 11 passes through the through hole of the cover 14 to form a flame surrounding the candlewick. The bottom edge of the cover 14 with though hole is disposed with two raised clamps 19 and the clamps 19 match with the gap 13 of the hollow cylinder.

The cover 14 is disposed with an aperture 15 used to mount a light-emitting body 16. The aperture 15 is near the root of the flame head 11. The support 5 is disposed with a small hole 17 used for a wire to connect the light-emitting body 16 with the power supply.

The working principle of the invention: when the electromagnetic coil is powered, it produces an electromagnetic field, which causes repulsion with the field produced by the lower magnet of the swingable device. When the swingable device deflects under the effects of magnetic force, it will be affected by its own gravity. When the gravity is higher than the magnetic force, the swingable device will swing backwards. As a result, under the interaction of the magnetic force and the gravity, the swingable device will swing without stop. Consequently the flame head at the top of the swingable device swings accordingly to create a simulated flame, so that the dynamic beauty is achieved.

The invention claimed is:

1. A swingable electronic candle, comprising:

a candle body, whose inside is a cavity a candle end including a support, a support frame movably hung to said support and a candlewick supported by said support frame, wherein inside said cavity is disposed with a candlewick, said candlewick includes a candle end and an electromagnetic coil underneath the candle end, said electromagnetic coil is driven by a drive circuit, said drive circuit is connected with a power supply, said support frame includes a large support axis and a small support axis that cross with each other, said large support axis is disposed with a hollow frame in the middle to support said small support axis, each end of said small support axis is movably supported in said hollow frame, each end of said large support axis is movably hung to said support, said candlewick and said small support axis are cross-connected with each other, a top of said candlewick is disposed with a flame head that is above said small support axis, and a bottom of said candlewick is disposed with a magnet that is under said small support axis.

2. The swingable electronic candle of claim 1, wherein said large support axis and said small support axis cross each other with an angle of 90°.

3. The swingable electronic candle of claim 1, wherein said hollow frame is an annular frame.

4. The swingable electronic candle of claim 1, wherein said support is a hollow cylinder and the upper edge of said hollow cylinder is disposed with a gap to support said large support axis.

5. The swingable electronic candle of claim 4, wherein said candle end is disposed with a cover with a through hole to cover said hollow cylinder, and said flame head passes through the through hole of said cover to form a flame surrounding the candlewick.

6. The swingable electronic candle of claim 5, wherein said cover with through hole is disposed with an aperture used to mount a light-emitting body, and said aperture is near the root of said flame head.

7. The swingable electronic candle of claim 6, wherein said support is disposed with a small hole used for a wire to connect said light-emitting body with the power supply.

8. The swingable electronic candle a of claim 1, wherein the sidewall of said hollow frame is disposed with two corresponding openings, and two ends of said small support axis are movably supported in said openings.

9. The swingable electronic candle of claim 5, wherein the bottom edge of said cover with though hole is disposed with two raised clamps and said clamps match with said gap of the hollow cylinder.

* * * * *

US008585234C1

(12) EX PARTE REEXAMINATION CERTIFICATE (10597th)

United States Patent
Ding

(10) Number: US 8,585,234 C1
(45) Certificate Issued: May 12, 2015

(54) SWINGABLE ELECTRONIC CANDLE

(75) Inventor: Yingqi Ding, Nantong (CN)

(73) Assignee: SHANGHAI Q MALL & CO. LTD., Zhabei District, Shanghai (CN)

Reexamination Request:
No. 90/013,292, Jul. 8, 2014

Reexamination Certificate for:

| | |
|---|---|
| Patent No.: | **8,585,234** |
| Issued: | **Nov. 19, 2013** |
| Appl. No.: | **13/586,160** |
| Filed: | **Aug. 15, 2012** |

(30) Foreign Application Priority Data

Mar. 30, 2012 (CN) ..... 2012 1 0088362

(51) Int. Cl.

| | |
|---|---|
| ***F21L 4/00*** | (2006.01) |
| ***F21S 10/04*** | (2006.01) |
| ***F21S 6/00*** | (2006.01) |
| *F21S 9/02* | (2006.01) |
| *F21Y 101/00* | (2006.01) |

(52) U.S. Cl.
CPC *F21S 10/046* (2013.01); *F21S 9/02* (2013.01); *F21S 6/001* (2013.01); *F21Y 2101/00* (2013.01)

(58) Field of Classification Search
None
See application file for complete search history.

(56) References Cited

To view the complete listing of prior art documents cited during the proceeding for Reexamination Control Number 90/013,292, please refer to the USPTO's public Patent Application Information Retrieval (PAIR) system under the Display References tab.

*Primary Examiner* — Michael J. Yigdall

(57) ABSTRACT

A swingable electronic candle includes a candle body having a cavity inside which is disposed a candlewick that includes a candle end and an electromagnetic coil underneath the candle end. The electromagnetic coil is driven by a drive circuit connected with a power supply. The candle end includes a support, a support frame and the candlewick. The support frame includes a large support axis and a small support axis that cross. The large support axis is disposed with a hollow frame to support the small support axis. Ends of the small support axis are movably supported in the hollow frame. Ends of the large support axis are movably hung to the support. The top of the candlewick is disposed with a flame head that is above the small support axis and the bottom of the candlewick is disposed with a magnet that is under the small support axis.

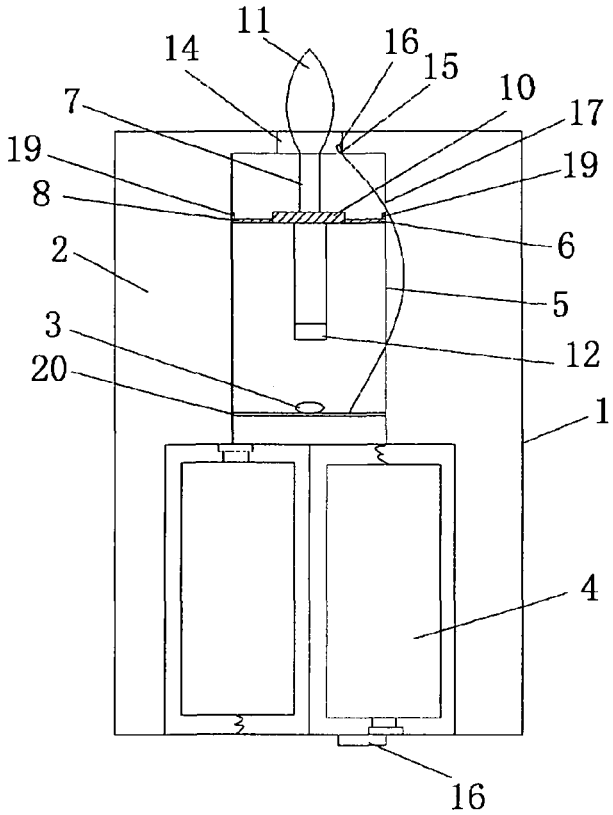

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-9 are cancelled.

* * * * *